US010182953B2

(12) United States Patent
Tsuber

(10) Patent No.: US 10,182,953 B2
(45) Date of Patent: Jan. 22, 2019

(54) WHEELCHAIR BACKREST MOUNTING SYSTEM

(71) Applicant: Sunrise Medical (US), LLC., Fresno, CA (US)

(72) Inventor: Vasily G. Tsuber, Thornton, CO (US)

(73) Assignee: Sunrise Medical (US), LLC, Fresno, CA (US)

( * ) Notice: Subject to any disclaimer, the term of this patent is extended or adjusted under 35 U.S.C. 154(b) by 15 days.

(21) Appl. No.: 15/337,009

(22) Filed: Oct. 28, 2016

(65) Prior Publication Data

US 2017/0119604 A1 May 4, 2017

Related U.S. Application Data

(60) Provisional application No. 62/247,540, filed on Oct. 28, 2015.

(51) Int. Cl.

| | |
|---|---|
| ***A47C 1/024*** | (2006.01) |
| ***A47C 7/40*** | (2006.01) |
| ***A47C 7/44*** | (2006.01) |
| ***A61G 5/02*** | (2006.01) |
| ***A61G 5/12*** | (2006.01) |
| ***A61G 5/10*** | (2006.01) |

(52) U.S. Cl.
CPC ..... *A61G 5/1067* (2013.01); *A61G 5/122* (2016.11)

(58) Field of Classification Search
CPC ..... A61G 5/1067; A61G 5/122
USPC ..... 297/354.11, 440.2
See application file for complete search history.

(56) References Cited

U.S. PATENT DOCUMENTS 3,215,468 A * 11/1965 Swenson ..... A47C 7/445 297/354.11 X
3,982,785 A * 9/1976 Ambasz ..... A47C 1/023 297/440.2 X
6,322,145 B1 * 11/2001 Melgarejo ..... A61G 5/1067 297/354.11 X
6,474,743 B1 * 11/2002 Harker ..... A61G 5/1067 297/354.11
6,659,563 B2 * 12/2003 Float ..... A47C 7/42 297/440.2 X
6,672,669 B2 * 1/2004 Chu ..... A47C 1/03 297/354.11 X
7,159,944 B1 * 1/2007 Tseng ..... A47C 7/48 297/354.11
7,278,688 B1 * 10/2007 Hung ..... A47C 7/024 297/354.11 X
7,347,496 B1 * 3/2008 Wang ..... A47C 1/023 297/354.11 X
7,387,339 B2 * 6/2008 Bykov ..... A47C 3/0252 297/354.11 X
7,475,943 B1 * 1/2009 Huang ..... A47C 7/405 297/354.11 X
8,376,463 B2 * 2/2013 Cooper ..... A61G 5/02 297/354.11

(Continued)

*Primary Examiner* — Rodney B White
(74) *Attorney, Agent, or Firm* — MacMillan, Sobanski & Todd, LLC

(57) ABSTRACT

A backrest mounting system provides angular and height adjustment of a backrest shell independent of backrest canes. The backrest mounting system attaches to a centrally located mounting structure on the backrest shell and defines at least two pivot axes that determine the angular position of the backrest shell relative to a wheelchair seat.

9 Claims, 5 Drawing Sheets

(56) References Cited

U.S. PATENT DOCUMENTS

| | | | | |
|---|---|---|---|---|
| 8,567,863 | B2 * | 10/2013 | Hetzel | A61G 5/1067 297/354.11 X |
| 8,590,977 | B2 * | 11/2013 | Bee | A61G 5/1067 297/440.2 |
| 8,602,496 | B2 * | 12/2013 | Lu | A47C 7/448 297/354.11 X |
| 9,010,864 | B2 * | 4/2015 | Goeckel | A61G 5/1067 297/440.2 |
| 2007/0222268 | A1 * | 9/2007 | Saez | A47C 3/04 297/354.11 |
| 2008/0036261 | A1 * | 2/2008 | Yang | A47C 7/405 297/354.11 |
| 2008/0157581 | A1 * | 7/2008 | Whelan | A61G 5/1067 297/440.2 |
| 2008/0217880 | A1 * | 9/2008 | Whelan | A61G 5/10 280/250.1 |
| 2009/0072105 | A1 * | 3/2009 | Cramer | A47C 7/42 297/440.2 X |
| 2010/0148556 | A1 * | 6/2010 | Chou | A47C 1/026 297/354.11 |
| 2010/0276974 | A1 * | 11/2010 | Huttenhuis | A47C 7/42 297/284.3 |
| 2015/0245964 | A1 * | 9/2015 | Tsuber | A61G 5/1067 297/363 |

* cited by examiner

WHEELCHAIR BACKREST MOUNTING SYSTEM

CROSS-REFERENCE TO RELATED APPLICATIONS

This application claims the benefit of U.S. Provisional Application No. 62/247,540, filed Oct. 28, 2015, the disclosure of which is incorporated herein by reference.

BACKGROUND OF THE INVENTION

This invention relates in general to wheelchair seating systems and, in particular, to an angle adjustable backrest mounting system.

Wheelchairs are typically intended to be used by persons having different size, physical constitutions, and impairments. These conditions are accommodated, in one respect, by providing adjustable seating systems that permit the seat and/or seat back to be positioned to the user's seated body contours. Many known seating systems provide a variety of adjustments but are either bulky or cumbersome to adjust so that the seated user is comfortable. In addition, many adjustable seating systems for manual wheelchairs rely on backrest canes as part of the backrest mounting structure. This adds extra weight and an obstacle for freedom of movement, particularly in light weight or sport wheelchairs. Thus, it would be desirable to provide a seat backrest adjustment mechanism that is easily adjustable, yet light weight and sized so that a variety of seat backs, particularly smaller seat back associated with sport chairs or light weight chairs, can be easily adjusted to a comfortable angular position.

SUMMARY OF THE INVENTION

This invention relates to wheelchair seatback mounting systems. This mounting system eliminates reliance on traditional backrest canes on the sides of the wheelchair to mount and support a backrest. This eliminates the interference between the canes and user's arms, particularly during propulsion, allowing greater freedom of body (trunk) movement and rotation. Since the backrest mounts are located in the center of the shell, the backrest width is not dependent on wheelchair width and can be smaller or larger than wheelchair. Mounting hardware is located in the center of the back shell and allows adjustment for different height and angular backrest positions.

Two pivoting axes allow additional height, depth and angle adjustment. This can be an infinite adjustment or incremental with gear/teeth feature on the offset mounts. Two offset mounts are inter-locked with a locking tube and screw connection to eliminate any misalignment in the backrest tubes.

Various aspects of this invention will become apparent to those skilled in the art from the following detailed description of the preferred embodiment, when read in light of the accompanying drawings.

DETAILED DESCRIPTION OF THE PREFERRED EMBODIMENT

Figure 1:
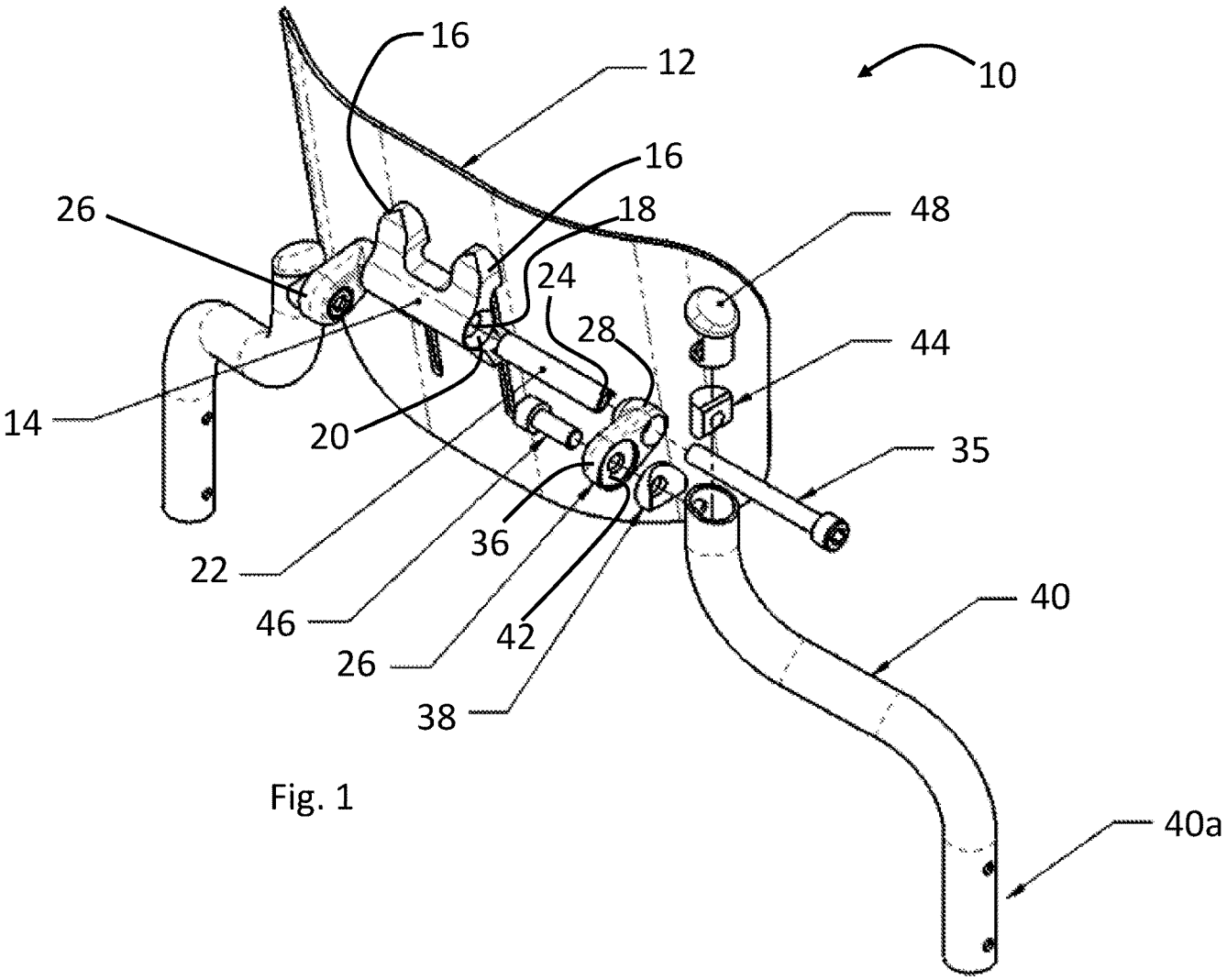
FIG. 1 is a perspective, partially exploded view of a backrest mounting system in accordance with the invention.
Figures 4, 5A, 5B:
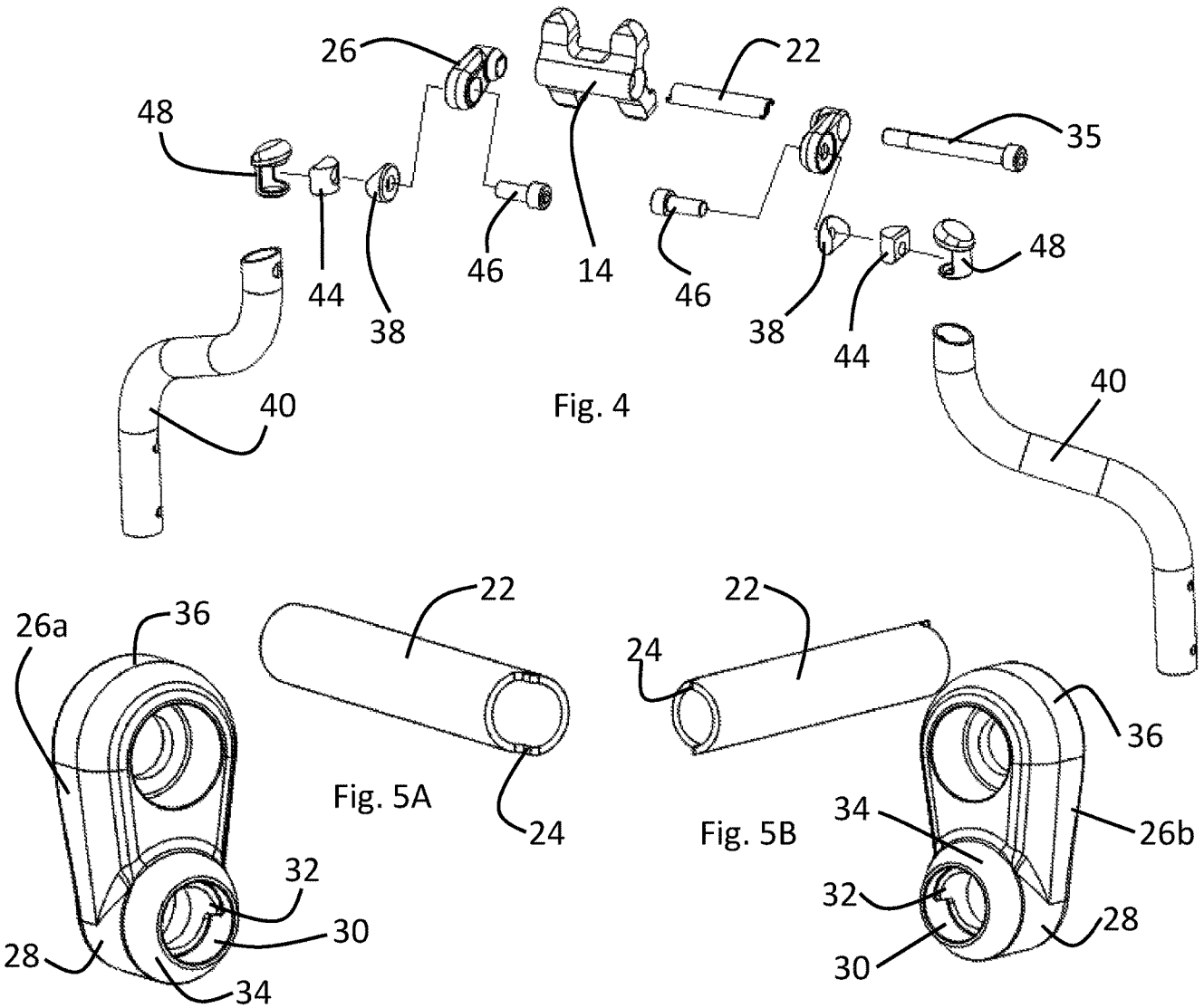
FIG. 4 is a perspective view of the backrest mounting system of FIG. 1.
FIGS. 5A and 5B are enlarged views of an embodiment of a position adjustment feature of the backrest mounting system of FIG. 4.

Referring now to the drawings, there is illustrated in FIG. 1 a wheelchair backrest mounting system, shown generally at 10. The backrest mounting system 10 attaches a backrest shell 12 to a wheelchair frame (shown at FIG. 6). The backrest mounting system 10 includes a mounting block 14 that is fastened to the backrest shell 12 by attachment pads 16. The mounting block 14 includes a bore 18 that extends therethrough and includes tapered or beveled receivers 20. An offset locking tube 22 is configured to extend through and be supported by the bore 18 for rotation. The offset locking tube 22 terminates in locking teeth 24. The illustrated locking teeth 24 are shown as tube end cutouts that have offset profiles along the tube longitudinal axis. Other tooth arrangements, such as multiple teeth, may be provided if desired. The locking tube 22 maintains spaced-apart offset mounts 26 oriented in alignment relative to each other. The offset mounts 26 include pivot ends 28, as shown in FIGS. 5A and 5B. In the illustrated embodiment, the offset mounts 26 are configured such that locking bores 30 in the pivot ends 28 are coaxially aligned. The locking bores 30 include a locking profile 32 that mates with the locking teeth 24 of the offset locking tube 22. Alternatively, the locking teeth 24 may be multiple teeth distributed around the end perimeter of the offset locking tube 22 in order to permit the offset mounts 26 to be indexed relative to each other. When so indexed, the mounting block 14 may be oriented at an angle relative to the wheelchair frame to accommodate specific user conditions such as lateral spinal curvature issues which cause a tilted seated position.

FIG. 5A illustrates the offset mount 26*a* configured for one side, such as a left side of the wheelchair and FIG. 5B illustrates the mirror image offset mount 26*b* for mounting on a right side of the wheelchair. Where the offset mounts 26 have locking bores 30 with multiple teeth (not shown) distributed around the locking bore inner diameter, the offset mounts 26*a* and 26*b* may be adjusted to provide a lateral tilt to the backrest shell 12. In order to provide the lateral angular adjustment described above, one offset mount 26*a* may be rotated in a direction opposite of the other offset mount 26*b*.

Figure 2A:
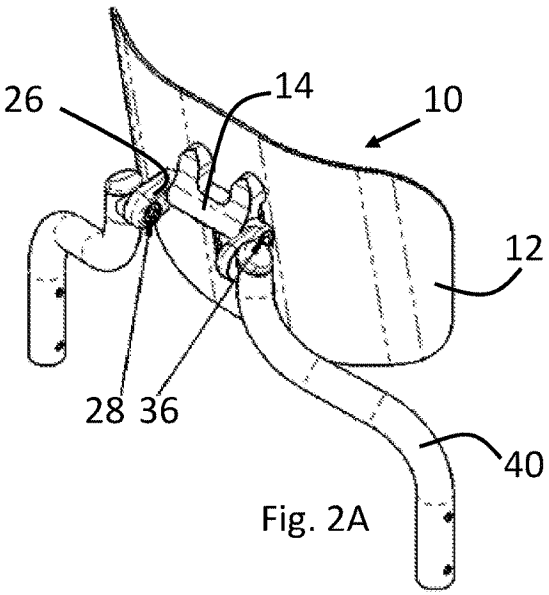
FIGS. 2A-2C are views showing adjustment points of the backrest mounting system.
Figure 2B:
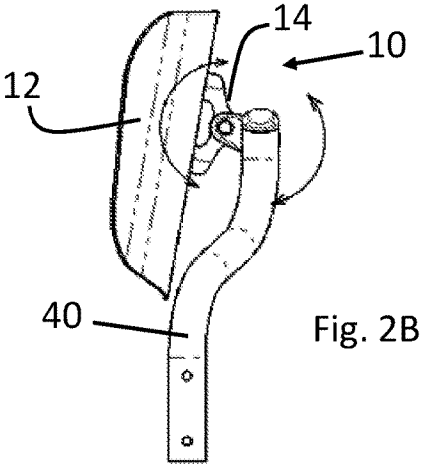
Figure 2C:
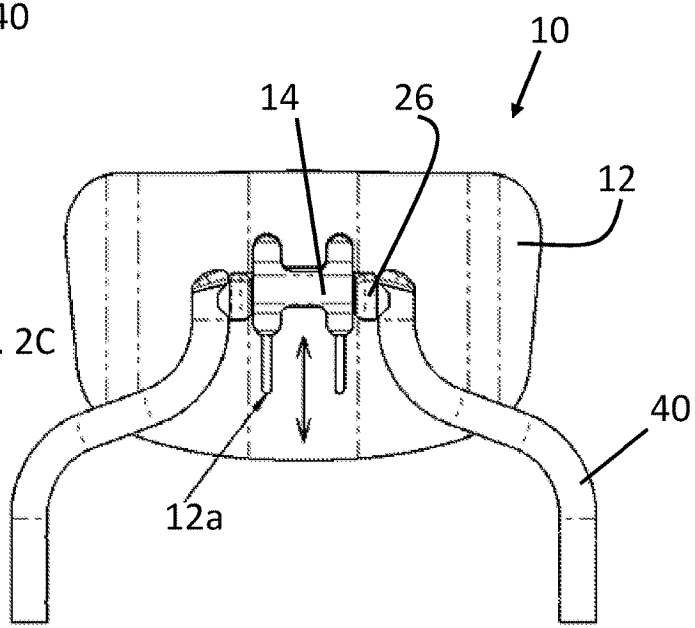
Figure 3A:
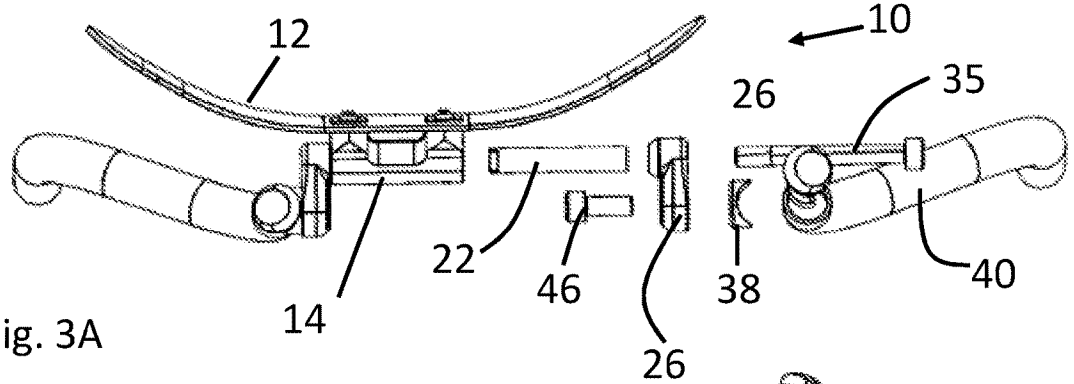
FIG. 3A is a plan view, partially exploded, of the backrest mounting system of FIG. 1.
Figure 3B:
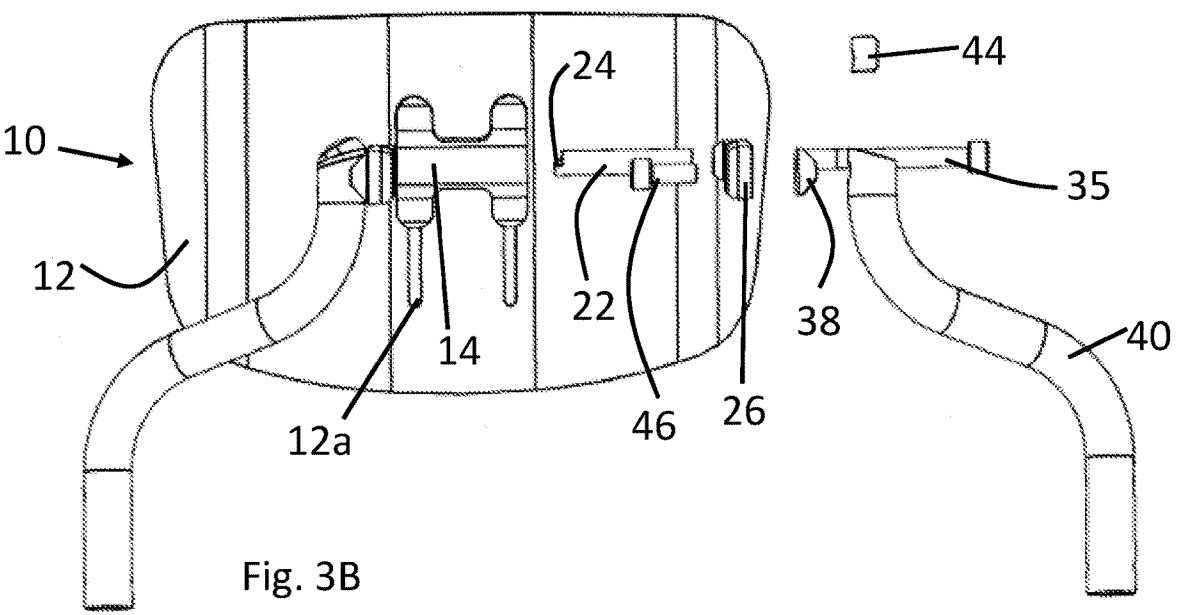
FIG. 3B is an elevational view, partially exploded, of the backrest mounting system of FIG. 1.

Both of the offset mounts will be described relative to one the offset mount 28. As shown in FIG. 5A, the pivot end 28 includes a tapered surface or cone-shaped surface 34 that mates with the tapered or beveled receiver 20 of the mounting block 14. The tapered surface 34 of the offset mount 26 is end loaded or compressed against the tapered receiver 20 to frictionally adjust the angular pivot orientation of the backrest shell 14, as shown in FIG. 2B. An adjustable fastener 35, such as a bolt, screw, or other length-adjustable connector extends through the offset locking tube 22 to end load the tapered surfaces 34 against the tapered receivers 20. The tapered surface 34 and the mating tapered receiver 20 are shown having smooth profiles to provide a free range of adjustment. Alternatively, this surface may be profiled, such as radially extending surfaces to provide a discrete series of adjustments. In operation, the bolt 35 may be loosened to permit rotation of the backrest shell 12 about the axis defined by the bore 18, as shown by the arrows of FIG. 2B. In addition the backrest shell 12 may be moved toward or away from an edge of a wheelchair seat by moving the offset mounts 26*a* and 26*b* together in a clockwise or counterclockwise direction. As shown in FIG. 2C, the backrest shell 12 may include adjustment slots 12*a* to permit height adjustment of the backrest shell 12 relative to the wheelchair seat of FIG. 6.

Figure 6:
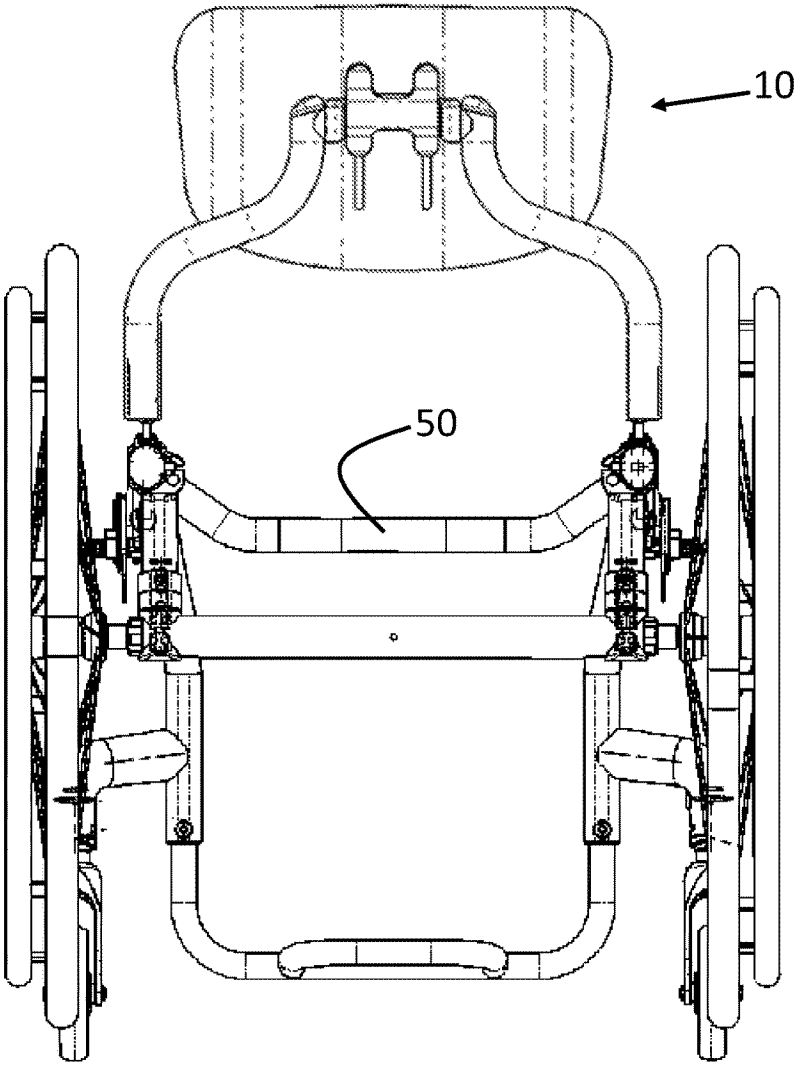
FIG. 6 is a rear elevational view of a wheelchair including the backrest mounting system of FIG. 1.

Referring again to FIG. 1, the offset mount 26 includes a frame mount 36 that engages a saddle 38 that supports the backrest relative to backrest frames or tubes 40. In one embodiment, the backrest tubes 40 may terminate in a mounting point 40*a* that permits attachment, either removable or permanent, to a wheelchair frame 52 of a wheelchair 50, as shown in FIG. 6. The frame mount 28 may include a mounting face 42 that contacts the saddle 38. In one embodiment, the mounting face 42 and the contacting face of the saddle 38 are smooth and permit a free range of angular adjustment, as shown by the arrows in FIG. 2B, of the backrest shell 12 relative to the backrest tubes 40. Alternatively, the surfaces may be profiled to permit discrete angular adjustment positions. A barrel nut 44 accepts a mounting screw 46; that extends through the frame mount 36, the saddle 38, and at least a portion of the backrest tube 40; to permit the connection to be tightened. In one embodiment, the barrel nut 44 is supported within a cap 48 that fits into an open end of the backrest tube 40, proximate to the backrest shell 12. In one adjustment operation, bolt 35 and mounting screws 46 may be loosened to permit the plane of the backrest shell 12 to be moved along a longitudinal axis of the wheelchair. In addition, the backrest shell may be rotated to an angular position relative to a side view of the wheelchair 50, as shown in FIG. 2B.

The principle and mode of operation of this invention have been explained and illustrated in its preferred embodiment. However, it must be understood that this invention may be practiced otherwise than as specifically explained and illustrated without departing from its spirit or scope.

What is claimed is:

1. A backrest mounting and position adjustment system for a wheelchair comprising:

a backrest shell having a side edges that define a backrest center and a centrally located mounting structure positioned about the backrest center;

at least one backrest frame configured to carry the backrest shell independent of a backrest cane, the backrest frame configured to be secured to a wheelchair frame;

a mounting block secured to the centrally located mounting structure of the backrest shell and defining a first pivot axis;

an offset mount secured for selective pivotal movement relative to the first pivot axis and defining a second pivot axis, the offset mount being secured to the backrest frame for selective pivotal movement about the second pivot axis.

2. The backrest mounting and position adjustment system of claim 1 wherein the mounting structure comprises at least two generally parallel slots and the mounting block is fastened to the mounting structure such that the backrest shell is height adjustable relative to a wheelchair seat.

3. The backrest mounting and position adjustment system of claim 1 wherein the offset mount is a pair of spaced apart offset mounts positioned on opposite sides of the mounting block.

4. The backrest mounting and positioning adjustment system of claim 3 wherein the mounting block retains an offset locking tube along the first pivot axis, the offset locking tube configured to fix the position of the pair of offset mounts relative to each other along the first axis.

5. The backrest mounting and position adjustment system of claim 4 wherein the second pivot axes of the pair of offset mounts are coaxially aligned and the backrest frame is a pair of spaced apart backrest tubes, each of the offset mounts are secured to a separate one of the spaced apart backrest tubes for selective pivotal movement along the aligned second pivot axes.

6. The backrest mounting and position adjustment system of claim 5 wherein a saddle is disposed between the backrest tube and the offset mount, the saddle defining an interfacing surface with the offset mount that permits a plurality of angular adjustment positions of the backrest shell.

7. The backrest mounting and position adjustment system of claim 6 wherein the plurality of angular adjustment positions are a plurality of discrete adjustment positions.

8. The backrest mounting and position adjustment system of claim 3 wherein the mounting block includes a pair of tapered surfaces that are frictionally engaged with mating, complementary surfaces on the pair of offset mounts.

9. A wheelchair having a backrest mounting and position adjustment system comprising:

a backrest shell having edges that define a center of the backrest shell;

at least one backrest frame configured to carry the backrest shell independent of a backrest cane, the backrest frame secured to a wheelchair frame;

a single mounting block secured to the center of the backrest shell and defining a first pivot axis;

a pair of spaced-apart offset mounts secured for selective pivotal movement relative to the first pivot axis and defining a second pivot axis, the offset mount being secured to the backrest frame for selective pivotal movement about the second pivot axis.

* * * * *